US005287258A

United States Patent [19]

Remus

[11] Patent Number: 5,287,258

[45] Date of Patent: Feb. 15, 1994

[54] HEADLAMP FOR MOTOR VEHICLES

[75] Inventor: Bodo Remus, Reutlingen/Altenburg, Fed. Rep. of Germany

[73] Assignee: Robert Bosch GmbH, Stuttgart, Fed. Rep. of Germany

[21] Appl. No.: 15,472

[22] Filed: Jan. 19, 1993

Related U.S. Application Data

[63] Continuation-in-part of Ser. No. 777,282, Nov. 27, 1991, abandoned.

[30] Foreign Application Priority Data

Apr. 4, 1990 [DE] Fed. Rep. of Germany ..... 4010829
Jan. 22, 1991 [DE] Fed. Rep. of Germany ..... 4101722

[51] Int. Cl.[5] ..... F21M 3/14

[52] U.S. Cl. ..... 362/256; 362/293; 362/311; 315/85; 313/313

[58] Field of Search ..... 362/61, 293, 311, 255, 362/256, 290; 313/313; 315/85

[56] References Cited

U.S. PATENT DOCUMENTS

| | | | |
|---|---|---|---|
| 3,342,119 | 9/1967 | Metcalfe et al. | 362/293 |
| 3,351,409 | 11/1967 | McGuire | 362/255 |
| 3,885,150 | 5/1975 | Ott | 362/290 |
| 4,524,410 | 6/1985 | Kawakatsu et al. | 362/255 |
| 4,677,532 | 6/1987 | Peitz et al. | 362/61 |
| 5,101,139 | 3/1992 | Lechter | 315/85 |
| 5,124,895 | 6/1992 | Segoshi et al. | 315/85 |

*Primary Examiner*—Carroll B. Dority
*Attorney, Agent, or Firm*—Michael J. Striker

[57] ABSTRACT

A headlamp for motor vehicles has a reflector having a light output opening, a gas discharge lamp arranged in the reflector, a screen covering the light output opening and means for shielding off interference radiation emitted by the gas discharge lamp and including a transparent interference-radiation-absorbing metallic coating.

9 Claims, 2 Drawing Sheets

HEADLAMP FOR MOTOR VEHICLES

CROSS-REFERENCE TO RELATED APPLICATIONS

This application is a continuation-in-part of patent application Ser. No. 777,282 filed on Nov. 27, 1991, and now abandoned.

BACKGROUND OF THE INVENTION

The present invention relates to a headlamp for motor vehicles. In particular it relates to a headlamp for motor vehicles which has a reflector with a gas discharge lamp and a screen covering a light output opening of the headlamp.

Such a headlamp is known from German Offenlegungsschrift 35 19 611. This headlamp has a reflector into which as gas discharge lamp protrudes. The light outlet opening of the headlamp is covered with a screen. In addition to the visible radiation, the gas discharge lamp also emits electromagnetic radiation in the non-visible range which can lead to interference, for example in broadcast reception in motor vehicles.

SUMMARY OF THE INVENTION

Accordingly, it is an object of the present invention to provide a headlamp for motor vehicles which avoids the disadvantages of the prior art and is a further improvement.

In keeping with these objects and with others which will become apparent hereinafter, one feature of the present invention resides, briefly stated, in a headlamp for motor vehicles in which interference radiation emitted by a gas discharge lamp is shielded off.

When the headlamp is designed in accordance with the novel features of the present invention, it has the advantage that the interference radiation emitted by the ga discharge lamp is shielded off and the gas discharge lamp does not cause any impairment of the broadcast reception.

In accordance with another feature of the present invention, the gas discharge lamp is provided with a transparent interference-radiation-absorbing metallic coating, or the screen is provided with such a coating.

Still another feature of the present invention is that a shielding part is arranged in the region between the gas discharge lamp and the screen and provided with the above mentioned transparent interference-radiation-absorbing-metallic coating.

A lens can be arranged between the gas discharge lamp and the screen and provided with a transparent interference-radiation-absorbing metallic coating.

The coating in any of the above modifications can be earthed.

Still another feature of the present invention is that a shielding device is constructed of thin, metallic wires arranged at a distance from one another and in the beam path between the gas discharge lamp and the screen.

Also, a lens can be arranged between the gas discharge lamp and the screen and a shielding device constructed of thin metallic wires at a distance from one another can be arranged in the unfocused region of the beam path between the gas discharge lens and the screen.

In both cases the wires of the shielding device can be earthed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
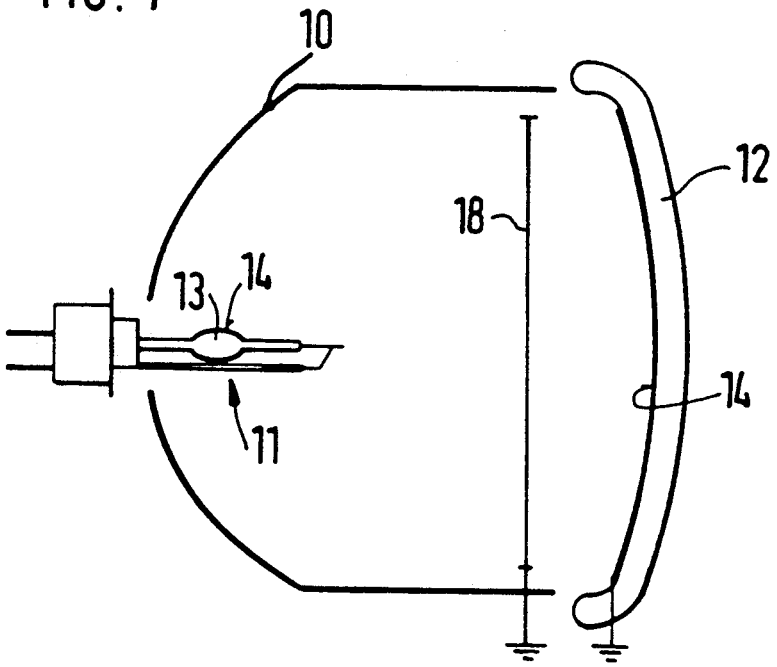
FIG. 1 shows a first illustrative embodiment of a headlamp in longitudinal section in a greatly simplified representation, FIG. 2 sows the headlamp in a front view

FIG. 1 shows a first illustrative embodiment of a headlamp for motor vehicles which has a reflector 10 into which a gas discharge lamp 11 is inserted. The light outlet opening of the headlamp is covered with a screen 12.

The screen 12 is transparent and can be composed of glass or synthetic plastic material. Moreover, the screen can be formed as a clear, smooth disc so that light can pass through it without changes. It can be provided with optical elements such as lenses or prisms, so that light which is reflected from the reflector and passes through the screen is deviated and/or dispersed.

The gas discharge lamp 11 has a glass bulb 13 which is provided with a transparent metallic coating 14. The coating is earthed and shields off electromagnetic radiation produced during the discharge process within the gas bulb, which could interfere with radio waves. Instead of the glass bulb 13 of the gas discharge lamp 11, the screen 12 can also be provided with a corresponding coating 14 in a variant of the headlamp.

The transparent metallic coating can be composed actually of any metal, while silver or silver alloys are especially suitable. However, it can be also composed of copper and copper alloys or gold and gold alloys. The thickness of the coating can be between approximately nanometer and substantially 20 micrometers. The thickness in the respective application is selected so that on the one hand a sufficient light permeability is guaranteed, or in other words not too much light is retained by it and thereby the lightbeam extending from the reflector is weakened. On the other hand, it ensures a reliable screening of the interference radiation. The coating can be applied by evaporation.

Figure 2:
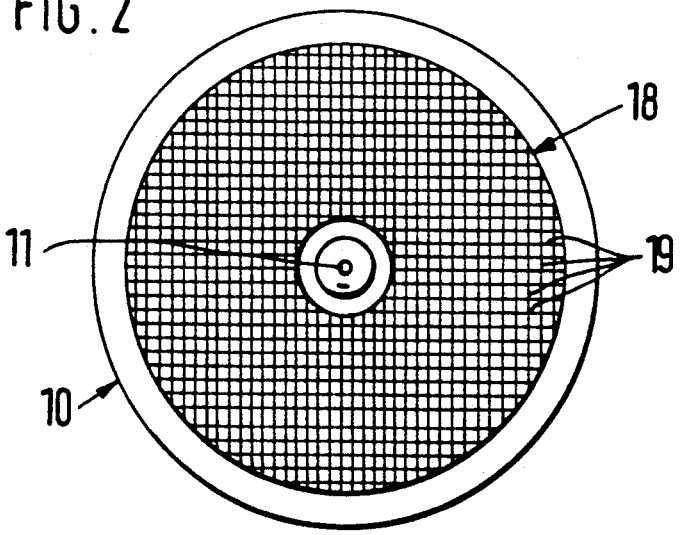

In a further variant of the headlamp according to FIG. 2, a shielding device 18 is arranged between the gas discharge lamp 11 and the screen 12. It consists of a multiplicity of thin metallic wires 19 which are arranged in the form of a net transversely to the direction of light emergence at such a distance from one another that sufficient light can pass between them. The wires 19 are earthed and can also be arranged in a different pattern, for example in the manner of a wire-mesh fence.

Figure 3:
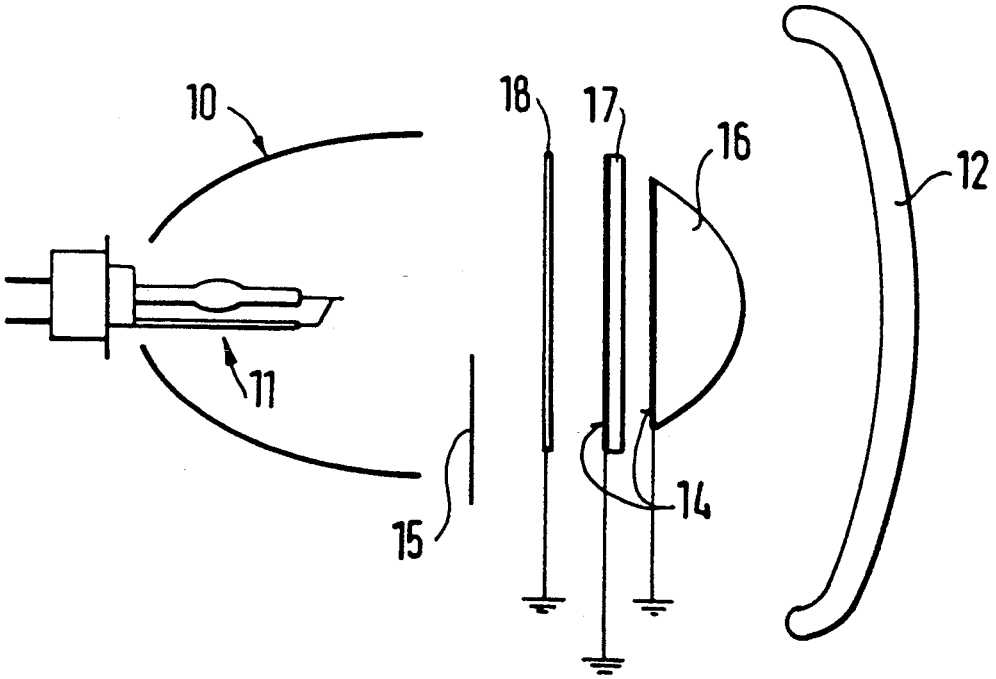
FIG. 3 shows a second illustrative embodiment of the headlamp in longitudinal section.

FIG. 3 shows a second illustrative embodiment of a headlamp in accordance with the projection principle. Here a diaphragm 15, a lens 16 and the screen 12 are arranged in the beam path of the light rays reflected by the reflector 10. The lens images the top edge of the diaphragm 15 as light/dark boundary of the light distribution. The lens 16 is provided with a coating 14 for shielding off the interference radiation as described with respect to FIG. 1, the coating 14 also being earthed. As an alternative, a shielding part 17 arranged between the gas discharge lamp 11 and the lens 16 can be provided with a corresponding coating 14.

The shielding part 17 is transparent so that light can pass through it without problems. It can be composed of glass or synthetic plastic material.

Alternatively, a shielding device 18, which is constructed as described for the first illustrative embodiment, can be arranged in the unfocused region of the beam path between the gas discharge lamp 11 and the lens 16 or between the lens 16 and the screen 12 in a variant of this headlamp.

It will be understood that each of the elements described above, or two or more together, may also find a useful application in other types of constructions differing from the types described above.

While the invention has been illustrated and described as embodied in a headlamp for motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

I claim:

1. A headlamp for motor vehicles, comprising a reflector having a light output opening; a gas discharge lamp arranged in said reflector; a screen covering said light output opening; and means for shielding off interference radiation emitted by said gas discharge lamp and including a transparent interference-radiation-absorbing metallic coating located between said gas discharge lamp and said light output opening.

2. A headlamp as defined in claim 1, wherein said transparent interference-radiation-absorbing metallic coating is provided on said gas discharge lamp located between said gas discharge lamp and said light output opening.

3. A headlamp as defined in claim 1, wherein said transparent interference-radiation-absorbing metallic coating is provided on said screen located between said gas discharge lamp and said light output opening.

4. A headlamp as defined in claim 1, wherein said means for shielding off includes a shielding part arranged in a region between said gas discharge lamp and said screen and provided with said transparent interference-radiation-absorbing metallic coating.

5. A headlamp as defined in claim 1, wherein said means for shielding off including a lens arranged in a region between said gas discharge lamp and said screen and provided with said transparent interference-radiation-absorbing metallic coating.

6. A headlamp as defined in claim 1; and further comprising a lens arranged in a region between said gas discharge lamp and said screen, said means for shielding off including said transparent interference-radiation-absorbing metallic coating provided on said lens.

7. A headlamp as defined in claim 1, wherein said coating is earthed.

8. A headlamp for motor vehicles, comprising a reflector having a light output opening; a gas discharge lamp arranged in said reflector; a screen covering said light output opening; and means for shielding off interference radiation emitted by said gas discharge lamp and including a shielding device arranged in an unfocused region of a beam path between said gas discharge lamp and said screen and composed of a plurality of thin metallic wires arranged at a distance from one another; and a lens arranged between said discharge lamp and said screen.

9. A headlamp as defined in claim 8, wherein said metallic wires of said shielding device are earthed.

* * * * *